US006619985B1

(12) United States Patent
Ko

(10) Patent No.: US 6,619,985 B1
(45) Date of Patent: Sep. 16, 2003

(54) MICRO COAXIAL CABLE CONNECTOR

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/121,067

(22) Filed: Apr. 11, 2002

(51) Int. Cl.[7] ..... H01R 13/648
(52) U.S. Cl. ..... 439/607; 439/579
(58) Field of Search ..... 439/607, 610, 439/579, 497, 108, 499

(56) References Cited

U.S. PATENT DOCUMENTS 5,980,308 A * 11/1999 Hu et al. ..... 439/497
6,123,582 A * 9/2000 Ko et al. ..... 439/579
6,273,749 B1 * 8/2001 Yang ..... 439/497
6,273,753 B1 * 8/2001 Ko ..... 439/579
6,305,978 B1 * 10/2001 Ko et al. ..... 439/579

* cited by examiner

*Primary Examiner*—Hien Vu
(74) *Attorney, Agent, or Firm*—Wei Te Chung

(57) ABSTRACT

A micro coaxial cable connector comprises a dielectric housing (40), a metal shield (10) enclosing the housing, a grounding plate (30) and a terminal block (20) received in the housing. The housing has a transverse portion (411) and a pair of lateral portions (413) extending rearwardly from a pair of lateral sides of the transverse portion. Side sections (418) of the housing serve as handles to allow a user to firmly grasp the connector when plugging and unplugging the connector with a mating connector. Each lateral portion further defines a split (419). The metal shield has an upper flap (11), a lower flap (12) and a pair of side flaps (14) upwardly extending from opposite side edges of the lower flap. The pair of side flaps extend into the splits of the housing to ensure contact between a grounding tab (123) of the shield and a grounding beam (33) of the grounding plate.

6 Claims, 9 Drawing Sheets

MICRO COAXIAL CABLE CONNECTOR

BACKGROUND OF THE INVENTION

1. Field of the Invention

The present invention relates to a micro coaxial cable connector, and particularly to a micro coaxial cable connector with a shield assembled thereon.

2. Description of Related Art

Metal shielding is commonly used in electrical connectors, especially in high speed application, to enclose an insulative housing and a plurality of contacts received in the housing thereby protecting signals transmitted through the connector from an external electromagnetic interference. U.S. Pat. Nos. 6,305,978, 6,305,979, 6,273,753 and 6,123,582 disclose conventional coaxial cable connectors. Referring to FIG. 9 (FIG. 1 of U.S. Pat. No. 6,305,978), a shield 7 comprises an upper flap 71, a lower flap 72 and a pair of side flaps 73 downwardly extending from opposite sides of the upper flap 71. The shield 7 encloses an insulative housing 8 which has a plurality of contacts received therein. The insulative housing 8 has a pair of blocks 81 formed on opposite ends thereof. Each side flap 73 defines a notch 731 corresponding to the block 81 of the housing 8. The pair of notches 731 engageably receive the corresponding blocks 81 of the housing 8 therein to prevent an upward disengagement of the upper flap 71 from the housing 8. This prior art micro coaxial cable connector does not have convenient grasping handles for manually plugging and unplugging the connector from a mating connector. A way to solve this problem is to form a pair of protruding sections on opposite sides of the housing 8. However, this change in the housing will necessitate a redesign of the shield. Thus, a new housing design and shielding structure for the coaxial cable connector is needed.

SUMMARY OF THE INVENTION

An object of the present invention is to provide a micro coaxial cable connector which is convenient to plug and unplug in a mating connector.

Another object of the present invention is to provide a micro coaxial cable connector which has a shield firmly assembled on a redesigned dielectric housing.

To achieve the above-mentioned objects, a micro coaxial cable connector of the present invention comprises a dielectric housing, a metal shield enclosing the housing, a grounding plate and a terminal block received in the housing. The dielectric housing has a transverse portion and a pair of lateral portions extending rearwardly from a pair of lateral sides of the transverse portion. A pair of side sections at out side edges of the lateral portions provide convenient grasping handles. The transverse portion defines a plurality of passageways therethrough. Each lateral portion defines a split. The grounding plate has at least one grounding beam. The terminal block has a plurality of conductive terminals received in the passageways of the housing. The metal shield comprises an upper flap, a lower flap and a pair of side flaps upwardly extending from opposite side edges of the lower flap. The lower flap forms at least one grounding tab electrically contacting the at least one grounding beam of the grounding plate. The pair of side flaps extend into the splits of the housing to ensure the grounding tab retains contact with the grounding beam.

Other objects, advantages and novel features of the invention will become more apparent from the following detailed description of the present embodiment when taken in conjunction with the accompanying drawings.

DETAILED DESCRIPTION OF THE INVENTION

Figure 1:
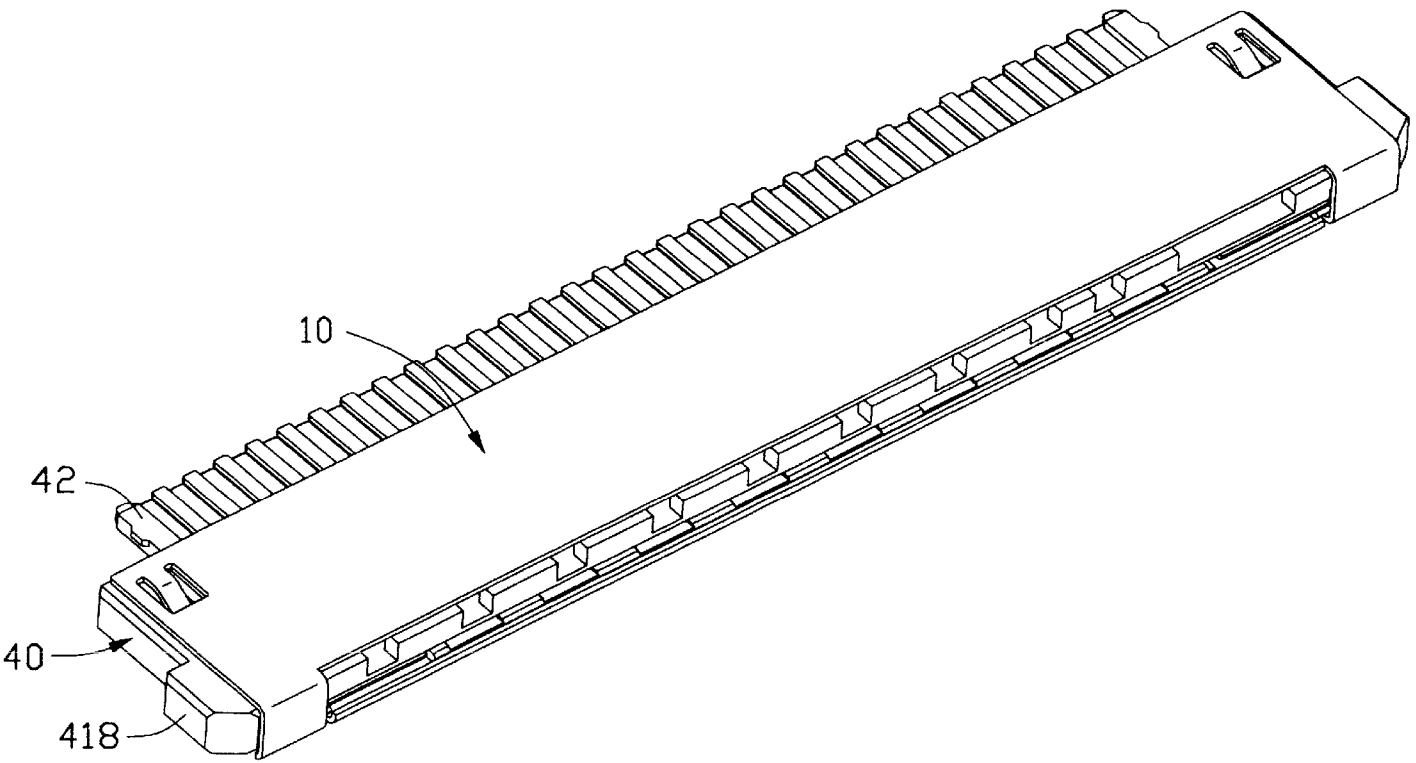
FIG. 1 is a perspective view from a top aspect view of a micro coaxial cable connector of the present invention.
Figure 2:
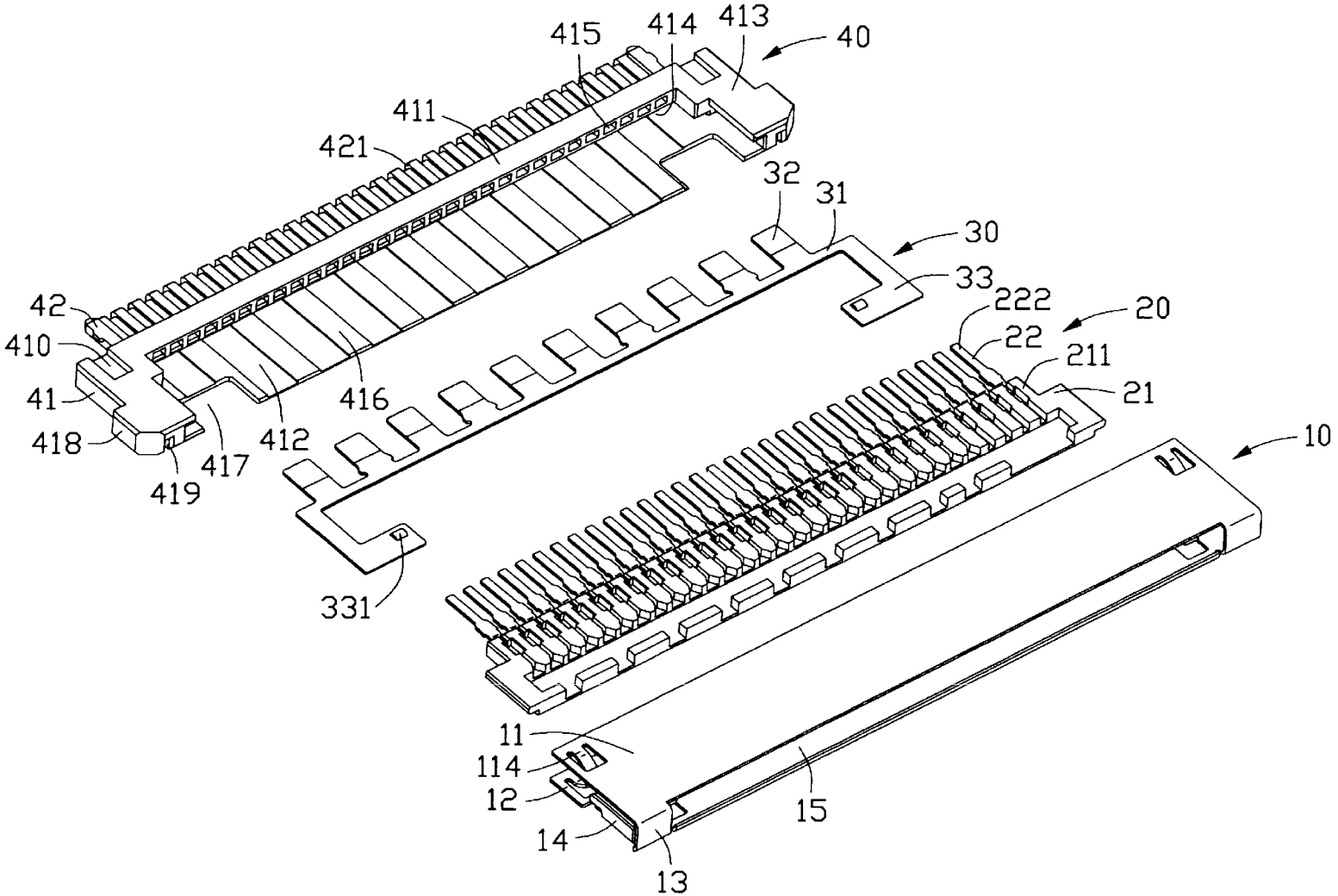
FIG. 2 is an exploded perspective view of FIG. 1.

Referring to FIGS. 1 and 2, a micro coaxial cable connector of the present invention comprises a dielectric housing 40, a metal shield 10 shrouding the housing 40, a terminal block 20 and a conductive grounding plate 30 received in the dielectric housing 40.

Figure 3:
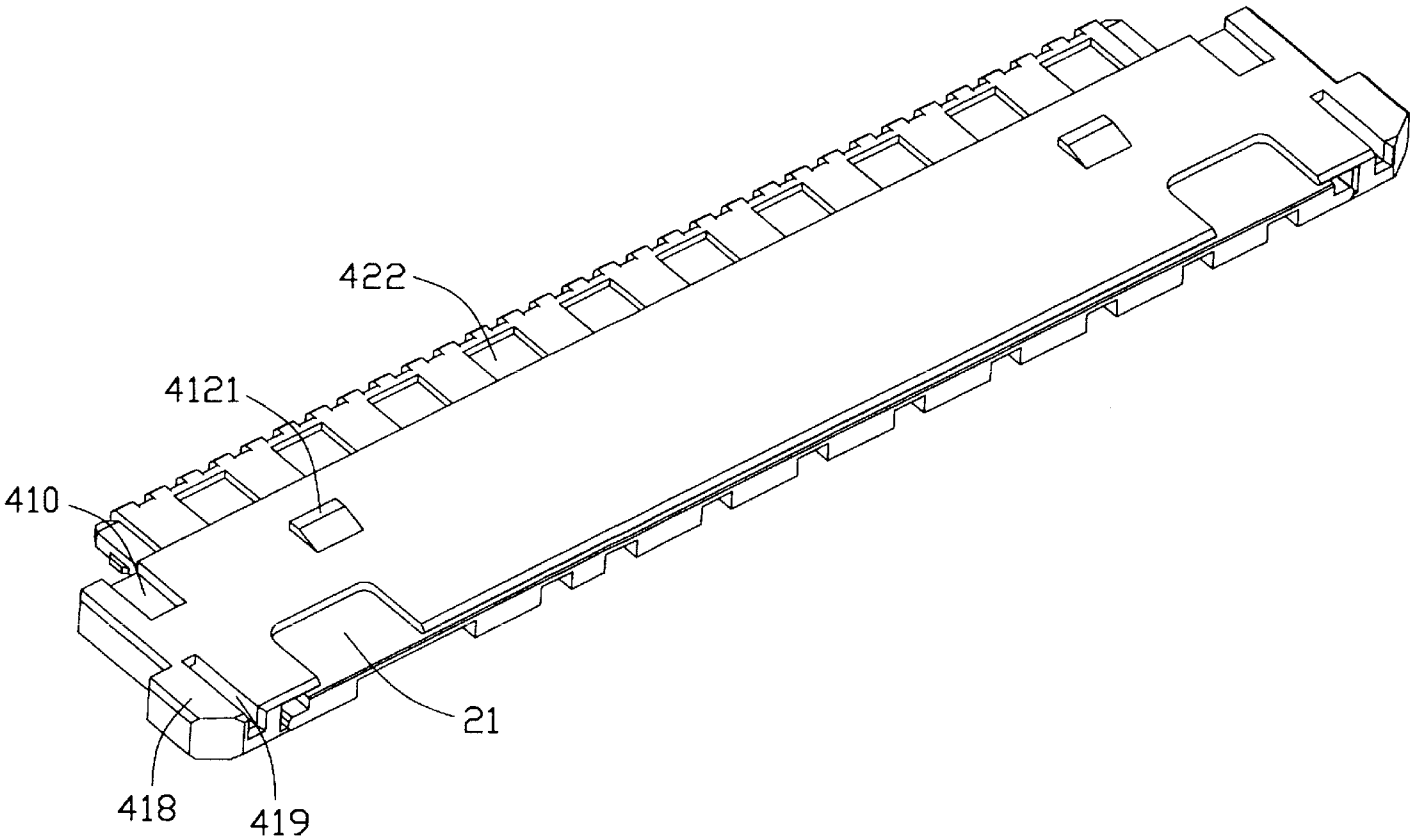
FIG. 3 is an enlarged perspective view of a bottom aspect of a housing and terminal block of the micro coaxial cable connector of FIG. 1.
Figure 8:
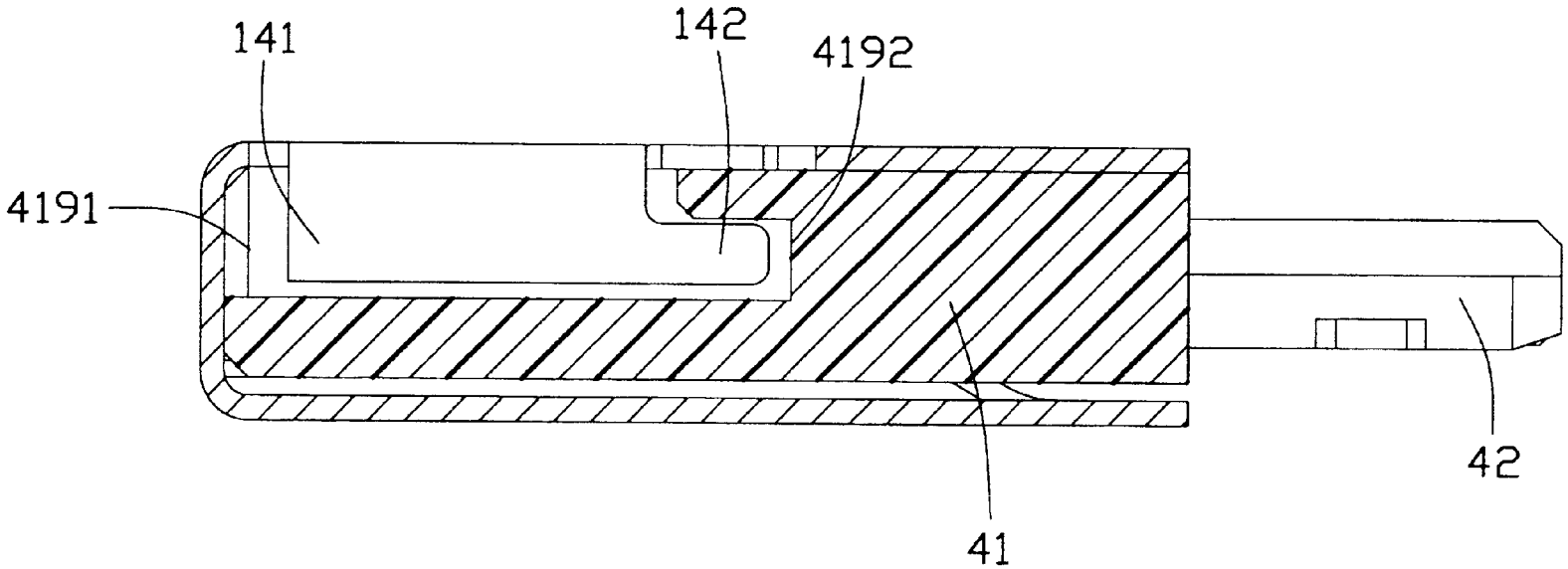
FIG. 8 is a cross-sectional view of the micro coaxial cable connector taken along a line 8—8 of FIG. 6.
Figure 9:
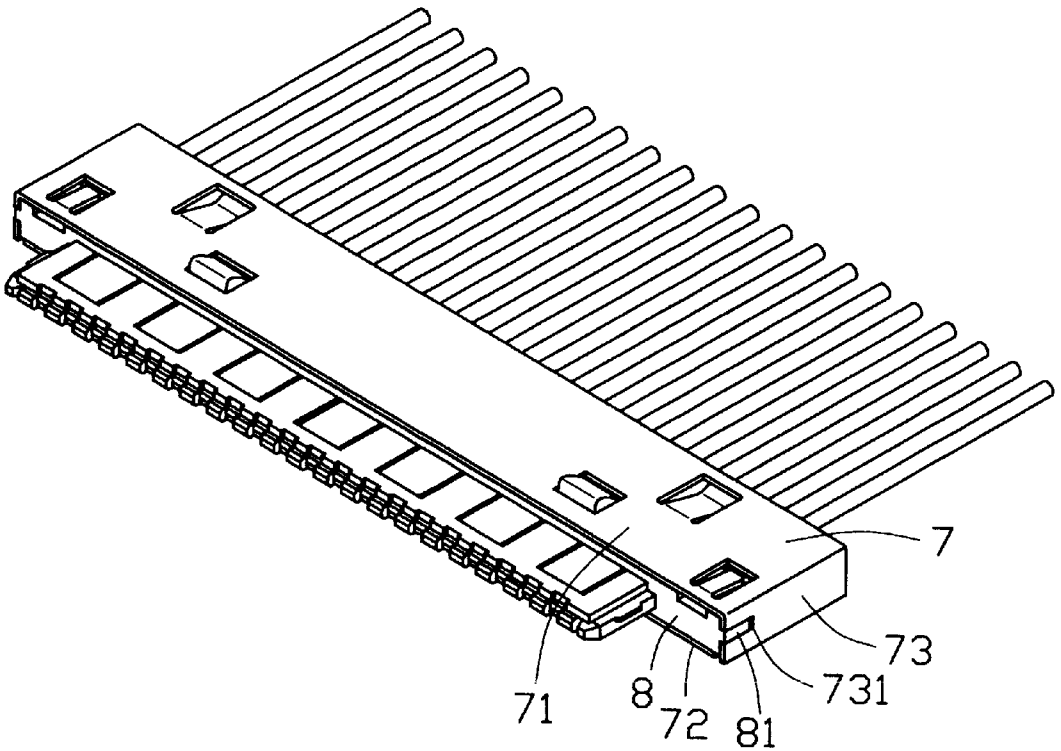
FIG. 9 (PRIOR ART)
FIG. 9 is a perspective view of a prior art micro coaxial cable connector.

Further referring to FIG. 3, the housing 40 includes a body portion 41 and a tongue portion 42 extending forwardly from the body portion 41. The body portion 41 further includes a transverse portion 411, a panel 412 and a pair of lateral portions 413. The panel 412 extends rearwardly from a bottom surface of the transverse portion 411. The pair of lateral portions 413 extends rearwardly from two lateral sides of the transverse portion 411 and is integral with opposite lateral side edges of the panel 412. An elongated slit 414 is defined between the transverse portion 411 and the panel 412 along a central segment of the transverse portion 411 such that the grounding plate 30 may extend therethrough. The transverse portion 411 defines a plurality of passageways 415 therethrough which further extend into grooves 421 defined in an upper surface of the tongue portion 42. The body portion 41 defines a receiving space 416 between the two lateral portions 413. The panel 412 defines a pair of cutouts 417 adjacent to a pair of lateral edges thereof. Each lateral portion 413 has a side section 418 protruding from a lateral surface thereof adjacent to a rear end of the lateral portion 413. Each lateral portion 413 also defines a split 419 in a bottom surface adjacent to the side section 418, and extending from a rear surface toward a front surface of each lateral portion 413. Each split 419 is divided into a first part 4191 (see FIG. 8) and a second part 4192 extending forwardly into the corresponding lateral portion 413 in front of the first part 4191. A retention recess 410 is defined in each of a top and bottom of a front end of each lateral portion 413. The grooves 421 are in communication with the passageways 415. The tongue portion 42 defines a plurality of receiving recesses 422 in a bottom surface thereof and in communication with the slit 414. The body portion 41 also has a pair of blocks 4121 (see FIG. 3) formed on a bottom surface thereof.

Figure 7:
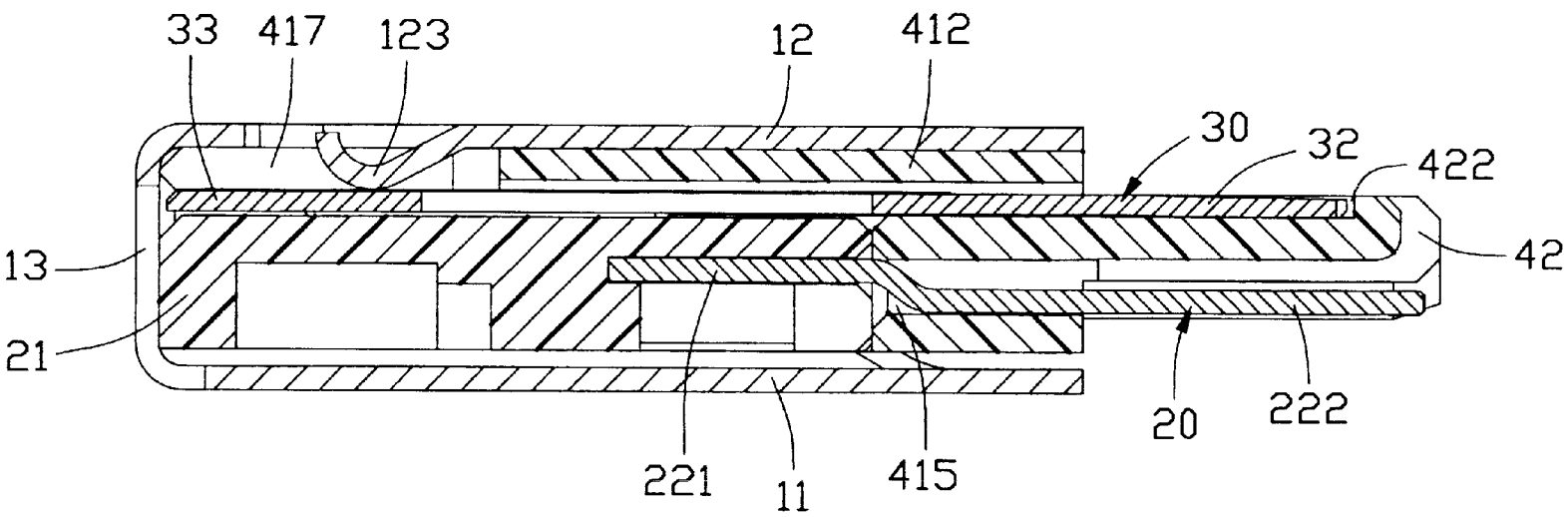
FIG. 7 is a cross-sectional view of the micro coaxial cable connector taken along a line 7—7 of FIG. 6.

The terminal block 20 includes a dielectric insert 21 and a plurality of conductive terminals 22. The terminals 22 are fixedly retained in a plurality of retainers 211 of the insert 21 via an engagement of tail portions 221 (shown in FIG. 7) of the conductive terminals 22 with the retainers 211. Contact portions 222 of the terminals 22 extend in front of the insert 21.

The grounding plate 30 has a connecting section 31, a plurality of grounding fingers 32, and a pair of grounding beams 33 extending from opposite ends of the connecting section 31. Each of the grounding beams 33 is generally'L' shaped and has a protruding portion 331 punched upwardly at a free end thereof.

Figure 4:
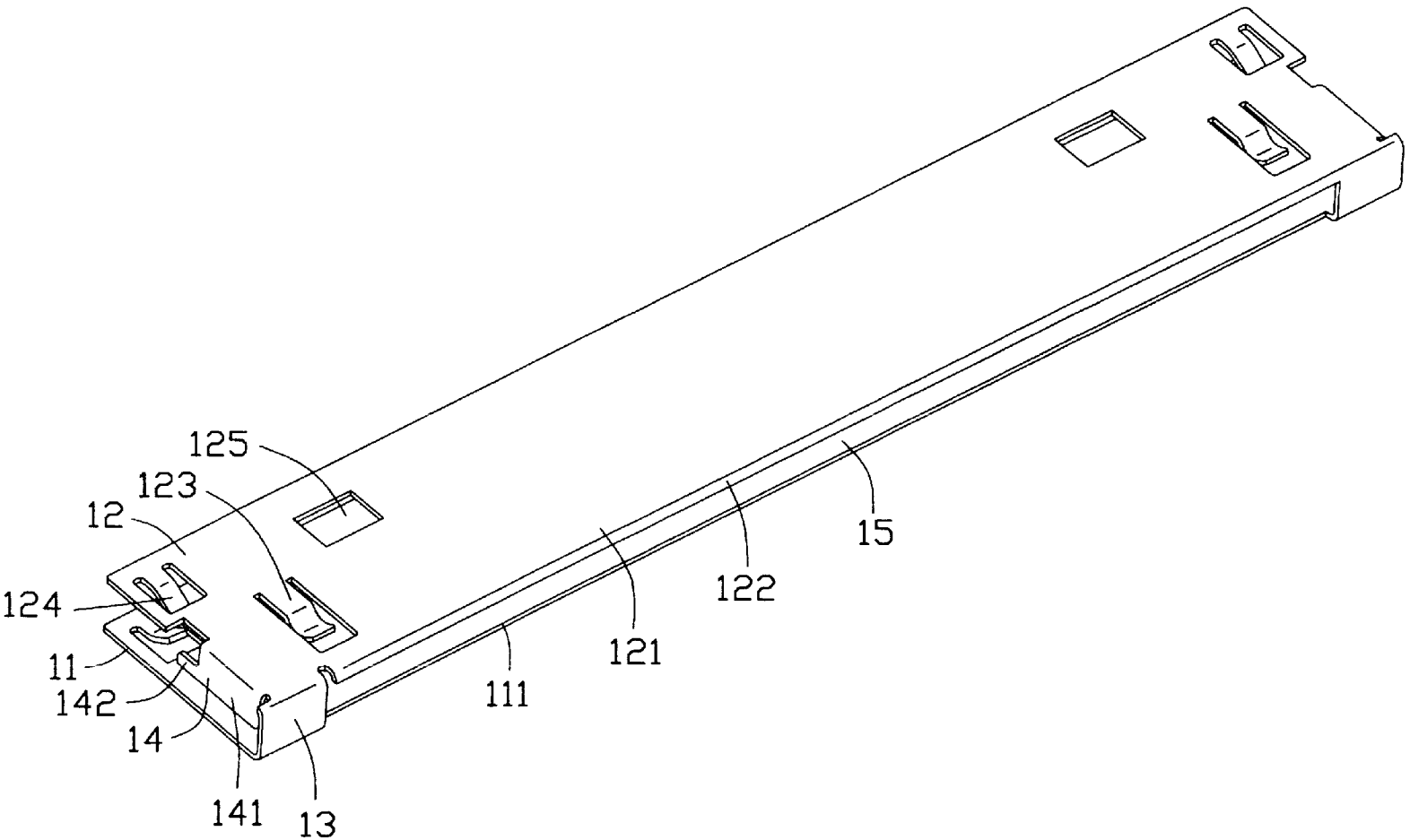
FIG. 4 is an enlarged perspective view from a bottom aspect of a metal shield of the micro coaxial cable connector of FIG. 1.
Figure 5:
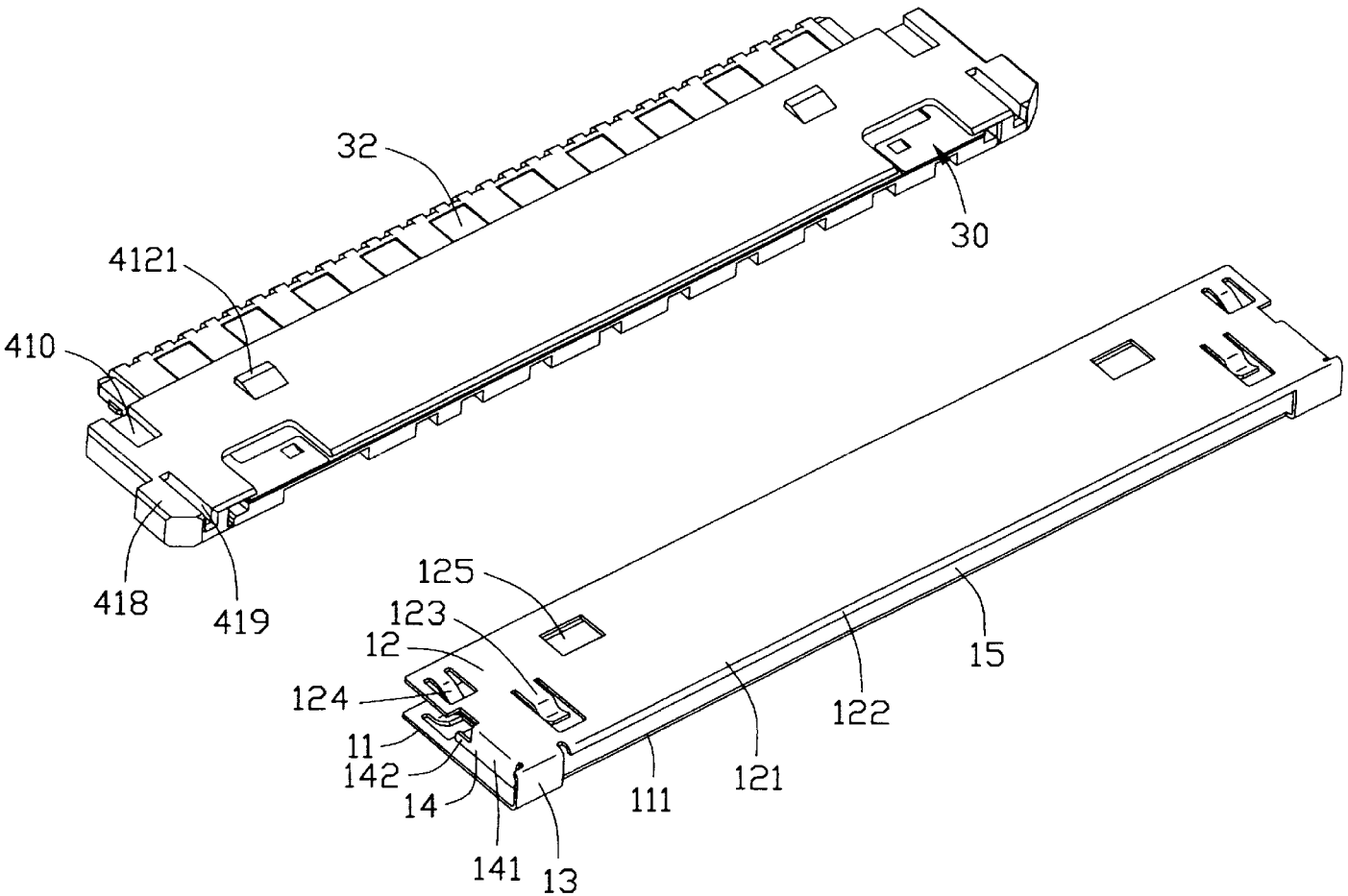
FIG. 5 is a perspective view of the micro coaxial cable connector from a bottom aspect before the shield is assembled to the housing.
Figure 6:
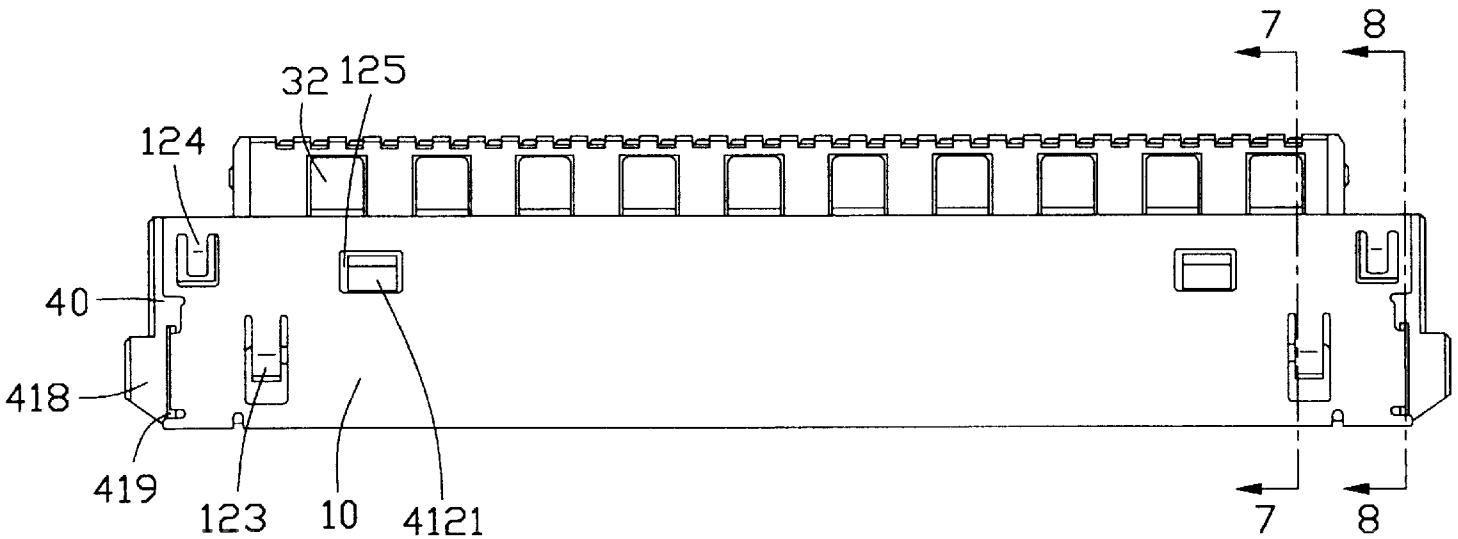
FIG. 6 is a bottom plan view of the micro coaxial cable connector of FIG. 1.

Referring to FIGS. 2 and 4, the metal shield 10 is illustrated in great detail. The metal shield 10 is stamped and bent from a piece of metal plate and comprises an upper flap 11, a lower flap 12 confronting the upper flap 11, a pair of connecting sections 13 and a pair of L-shaped side flaps 14 upwardly extending from opposite side edges of the lower flap 12. The upper and lower flaps 11, 12 together define a chamber 15 therebetween. The connecting sections 13 connect rear edges 111, 121 of the upper and lower flaps 11, 12 and are located adjacent to opposite side edges of the upper and lower flaps 11, 12. The upper flap 11 has a pair of upper retention tabs 114 formed downwardly near a front end thereof and extending into the chamber 15. The lower flap 12 has a tab-shaped flange 122 which upwardly extends from the rear edge 121. The lower flap 12 forms a pair of grounding tabs 123 and a pair of lower retention tabs 124 which upwardly extend into the chamber 15. The pair of grounding tabs 123 are adjacent to the rear edge 121 of the lower flap 12 while the pair of lower retention tabs 124 are adjacent to a front edge of the lower flap 12. The lower flap 12 also defines a pair of openings 125 located between the lower retention tabs 124. The side flap 14 has a main body 141 and a tail portion 142 extending forwardly from a front edge of the main body 141 and adjacent to an upper edge of the main body 141.

Referring to FIGS. 5–8, in assembly, the terminal block 20 and the grounding plate 30 are engageably received in the receiving space 416 of the housing 40 while contact portions 222 of the terminals 22 are fixedly received in the corresponding passageways 415 and grooves 421 of the housing 40 and are exposed from the upper surface of the tongue portion 42. The connecting section 31 of the grounding plate 30 is received in the slit 414 of the housing 40 with the grounding fingers 32 being fixedly received in the corresponding receiving recesses 422 of the tongue portion 42 and the grounding beams 33 being received in the receiving space 416 above the cutouts 417. The protruding portion 331 of each grounding beam 33 abuts on a bottom surface of the terminal block 20. After the metal shield 10 is assembled on the housing 40, the pair of connecting sections 13 generally abut against a rear surface of the body portion 41 of the housing 40. The pair of openings 125 engageably receive the pair of blocks 4121 of the housing 40. The upper and lower retention tabs 114, 124 are engageably received in the retention recesses 410, respectively. The pair of grounding tabs 123 respectively extend through the pair of cutouts 417 of the housing 40 to electrically and resiliently contact the corresponding grounding beams 33 of the grounding plate 30. The side flaps 14 of the metal shield 10 are engageably received in the splits 419 with the main bodies 141 of the side flaps 14 being received in the first parts 4191 of the splits 419 and the tail portions 142 of the side flaps 14 being received in the second parts 4192 of the splits 419 to prevent a downward disengagement of the lower flap 12 from the housing 40, whereby the normal force exerted by the pair of grounding tabs 123 against the grounding beams 33 is maintained. The micro coaxial cable connector is convenient plugging and unplugging with a mating connector because the side sections 418 make the housing 40 easier to grasp. The metal shield 10 firmly attaches to the housing 40 by use of the L-shaped side flaps 14. This attachment prevents disconnection of the grounding tabs 123 from the grounding beams 33, assuring grounding of the shield 10 and consequent protecting signals transmitted through the micro coaxial cable connector from outside electromagnetic interference.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro coaxial cable connector comprising:

a dielectric housing having a transverse portion and a pair of lateral portions extending rearwardly from a pair of lateral sides of the transverse portion, the transverse portion defining a plurality of passageways therethrough, each lateral portion defining a split;

a conductive grounding plate being assembled into the housing and having at least one grounding beam;

a terminal block being received in the housing and having a plurality of conductive terminals received in the passageways of the body portion; and a metal shield enclosing the housing and comprising an upper flap, a lower flap and a pair of side flaps extending upwardly from opposite side edges of the lower flap, the lower flap forming at least one grounding tab electrically contacting the at least one grounding beam of the grounding plate, the pair of side flaps extending into the splits of the housing to ensure that the grounding tab electrically connects with the grounding beam; wherein each split is divided into a first part and a second part extending forwardly into the lateral portion in front of the first part, each side flap comprises a main body and a tail portion extending forwardly from a front edge of the main body and adjacent to an upper edge of the main body, the main body of the side flap being received in the first part of the split and the tail portion being received in the second part of the split; wherein each lateral portion of the housing has a side section extending from a lateral surface thereof and adjacent to a rear end of the lateral portion, the split being formed to an inner side of the side section; wherein the metal shield has a pair of connecting sections connecting rear edges of the upper and lower flaps and located adjacent to opposite side edges of the upper and lower flaps.

2. The micro coaxial cable connector as described in claim 1, wherein the transverse portion of the housing has a panel extending rearwardly from a bottom surface of the transverse portion, and the two lateral portions are integral with opposite lateral side edges of the panel.

3. The micro coaxial cable connector as described in claim 2, wherein the panel defines a pair of cutouts adjacent two lateral edges thereof, and the grounding tabs of the shield extend into the cutouts.

4. The micro coaxial cable connector as described in claim 3, wherein the transverse portion and the panel defines an elongated slit therebetween along a central segment of the transverse portion, and the grounding plate extends through the slit.

5. The micro coaxial cable connector as described in claim 1, wherein the housing has a tongue portion extending forwardly from the transverse portion, the tongue portion defines a plurality of grooves on a top surface in communication with the passageways of the transverse portion, and the terminals of the terminal block are received in the grooves respectively.

6. The micro coaxial cable connector as described in claim 1, wherein the lateral portions each defines a pair of retention recesses, one in a top upper and one in a bottom surfaces thereof, and the upper and lower flaps each has a pair of retention tabs extending inwardly and being received in corresponding retention recesses.

* * * * *